US005283909A

United States Patent [19]

Hill

[11] Patent Number: 5,283,909

[45] Date of Patent: Feb. 8, 1994

[54] LAP HUGGER

[76] Inventor: Lucille K. Hill, 1315 Chapel View Dr., Odenton, Md. 21113

[21] Appl. No.: 929,437

[22] Filed: Aug. 14, 1992

[51] Int. Cl.[5] ..... A41D 3/00; A41B 13/06

[52] U.S. Cl. ..... 2/69; 2/695; 2/22; 2/247

[58] Field of Search ..... 2/69, 69.5, 46, 47, 2/48, 89, 247, DIG. 7, 70, 71, 72, 22; 5/482, 484, 485, 494

[56] References Cited

U.S. PATENT DOCUMENTS

| | | | |
|---|---|---|---|
| 633,134 | 9/1899 | Hansen | 2/69 |
| 704,276 | 7/1902 | Sorensen | 2/69 |
| 1,423,908 | 7/1922 | Burchard | 2/69 |
| 1,519,741 | 12/1924 | Schickerling | 2/69 |
| 1,706,224 | 3/1929 | Foote | 2/69 |
| 2,146,400 | 2/1939 | Maker et al. | 2/69 |
| 2,230,689 | 2/1941 | Kemp | 2/69 |
| 2,705,325 | 4/1955 | Bogenberger | 2/69 |
| 2,707,988 | 5/1955 | Shaub et al. | 2/69.5 |
| 2,712,133 | 7/1955 | Coleman | 2/69 |
| 2,716,239 | 8/1955 | Barndollar | 22/69.5 |
| 3,329,971 | 7/1967 | Shelby | 2/69 |
| 3,597,764 | 8/1971 | Povey | 2/69.5 |
| 3,727,238 | 4/1973 | Wolfson | 2/69 |
| 3,798,676 | 3/1974 | Shanks et al. | 2/69.5 |
| 3,919,721 | 11/1975 | Earhart | 2/69 |
| 4,240,159 | 12/1980 | Wrightson | 2/69 |
| 4,241,721 | 12/1980 | Holly | 2/69 |
| 4,363,141 | 12/1982 | Doster | 2/69.5 |
| 4,502,154 | 3/1985 | Itoi | 2/108 |
| 4,514,870 | 5/1985 | Tyler, Jr. | 5/485 |
| 4,611,353 | 9/1986 | Als et al. | 2/69 |
| 4,826,242 | 5/1989 | Trethewey | 2/69 |

OTHER PUBLICATIONS

Gershman, Maurice, M.D., Journal of the American Medical Assn.-vol. 68, No. 7., p. 930.

*Primary Examiner*—Clifford D. Crowder
*Assistant Examiner*—Gloria Hale
*Attorney, Agent, or Firm*—George C. Atwell; Clarence L. Carlson

[57] ABSTRACT

A lap hugger for receiving and containing the legs and extending to the waist of an individual for draping over the upper thighs of the individual when seated in a recliner-type chair or wheelchair. The lap hugger includes a lower tubular leg enclosure portion and an upper portion which extends upwardly from the lower tubular portion. The lower tubular portion receives and encloses the individual's legs and the upper portion extends up to the individual's waist for resting thereupon. The upper portion includes a pair of oppositely-disposed, laterally-extending flaps that drape over and cover the individual's upper thighs. An interior storage pocket is affixed to a rear side of the lower tubular portion for holding therein personal items and/or medical paraphernalia, such as catheter equipment.

2 Claims, 2 Drawing Sheets

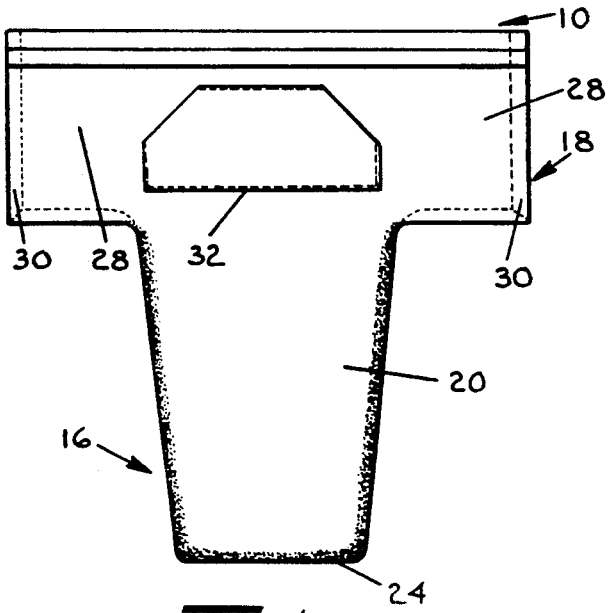
Fig. 1
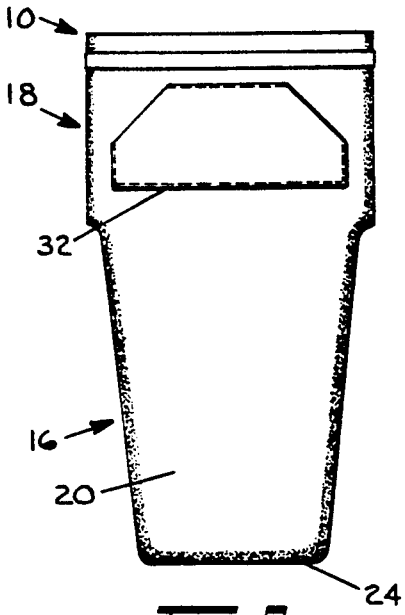
Fig. 2
Fig. 3
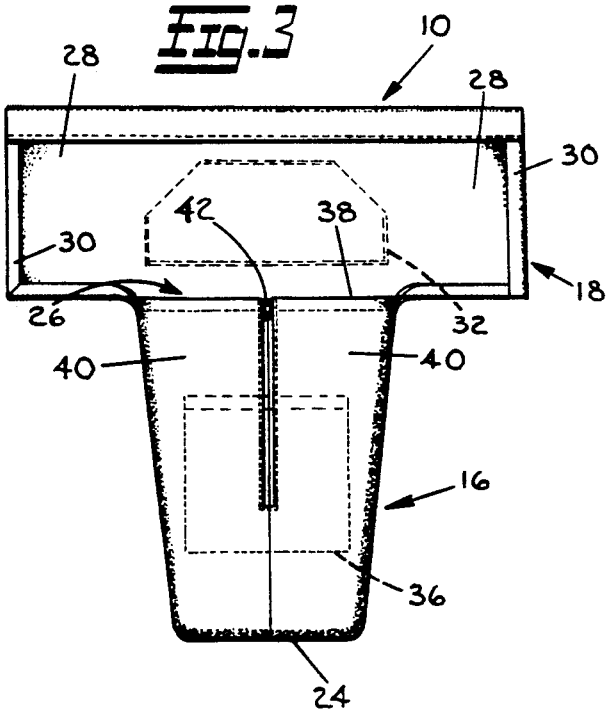
Fig. 4
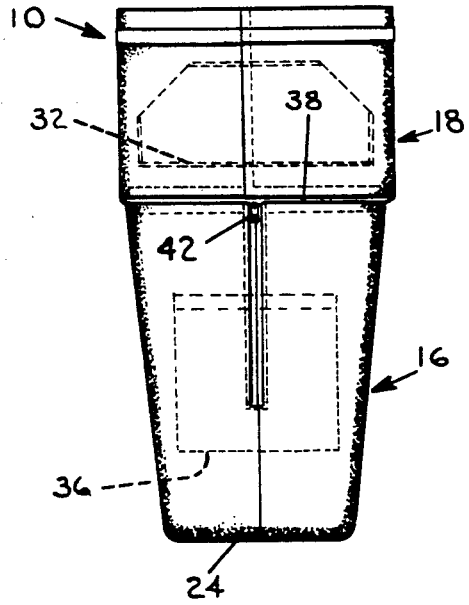

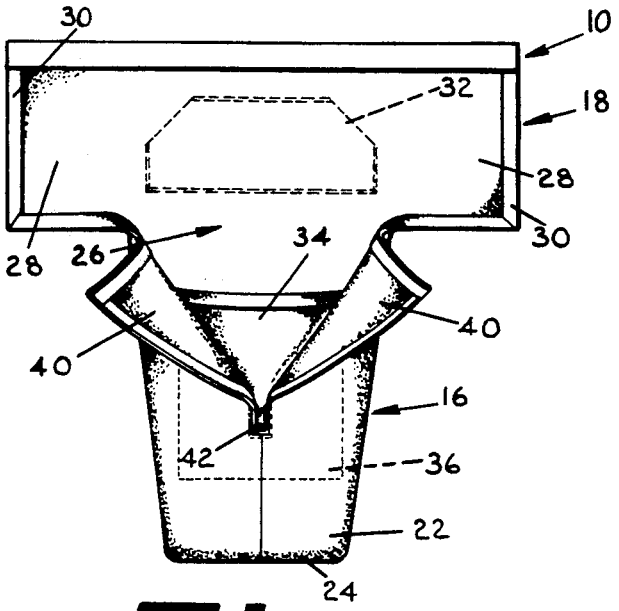
Fig. 5
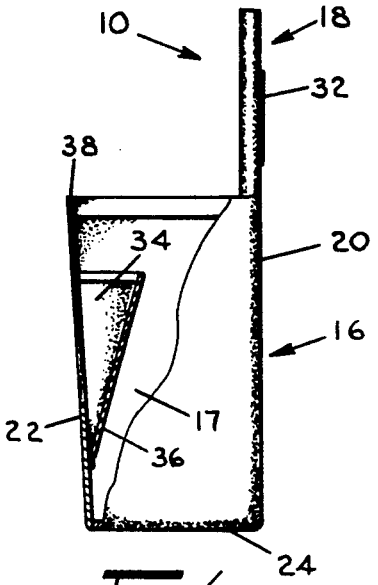
Fig. 6
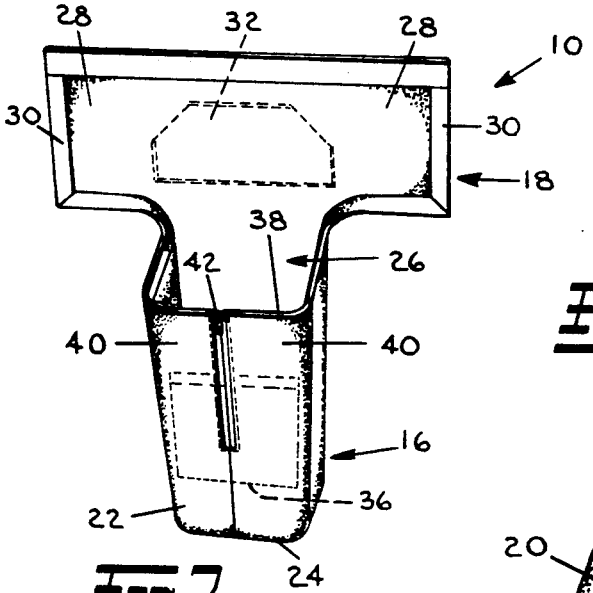
Fig. 7
Fig. 8
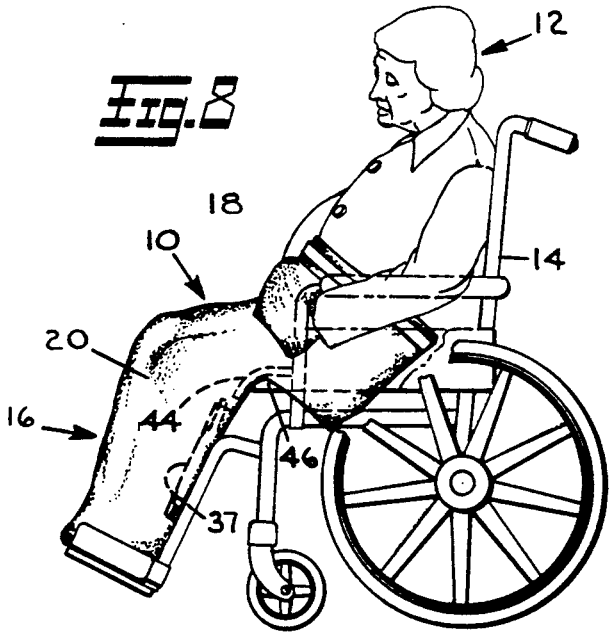

LAP HUGGER

BACKGROUND OF THE INVENTION

The present invention relates to comfort garments, and more particularly pertains to a sack-type garment that receives and encloses an individual's legs and rests upon the waist of the individual when seated in a recliner chair or wheelchair.

Garments for enclosing or wrapping around an individual are well known in the art. The garments are generally of a flexible, washable fabric or linen material that fits comfortably around an individual seated in a wheelchair, a recliner, a chaise lounge, bed, or sofa. The garment may include a fleece or down material as an insulative liner, and it may even have a fire retardant outer layer or covering. In addition, the garment may include outer and inner pockets for holding material ranging from household items to medical paraphernalia.

There is disclosed in the prior art a number of garment-type items for use by an individual. Among the garment-type items is the Comfort blanket garment wrap, U.S. Pat. No. 4,534,065, which discloses a blanket/comforter for wrapping about one's legs. The Comfort invention is shaped into a tube by making several folds to bring edges of the comforter in mating relationship by use of Velcro strips. A pocket is sewn on the inside surface of the comforter for receiving and holding a heating pad.

U.S. Pat. No. 4,363,141 (Doster) discloses a quilt for use with wheelchairs having a pouch for the feet that extends to the back of the knee area and includes a drawstring for tightening the pouch about the knees. A pocket, either external or internal, is sewn to a lap panel which extends over the lap of the wearer.

U.S. Pat. No. 2,716,239 (Barndollar) discloses a unitary body garment enwrapped about the patient's body to keep the patient warm and comfortable. A slide fastener closure means is provided on the front of the garment to allow the garment to form an envelope for the patient's body.

Despite the efficacy of the above inventions there remains a need for a comfort garment that provides more comfort and warmth than a standard lap robe, provides structure for holding or containing medical paraphernalia, such as catheter equipment, out of view when the individual is seated in a wheelchair, and also provides easy access to the medical paraphernalia for removal or replacement.

SUMMARY OF THE INVENTION

The present invention comprehends a lap hugger for receiving and containing an individual's legs and which extends up to the individual's waist for resting upon and covering the waist and thighs when the individual is seated in a recliner-type chair or a wheelchair. More specifically, the lap hugger of the present invention is a unitary garment of a soft, comfortable material, easily folded for storage and transportation, for use with geriatric, recliner, or wheelchair-bound patients. Bunting material is one preferred material in that it launders well and does not easily slide off the individual when the individual is seated in a wheelchair.

When fully stretched out on a flat surface, the lap hugger has a T-shaped appearance. The lap hugger is of unitary construction and includes a lower tubular leg enclosure portion defining an inner cavity and an upper portion integrally formed from the leg enclosure portion. The leg enclosure portion includes a closed bottom end and an open top, and the inner cavity receives, encompasses, and contains therein the individual's legs. The leg enclosure portion has a front side which covers the legs of the individual seated in a wheelchair, and a rear side which covers the individual's legs and extends up to the thigh area on the backside of the legs. An interior storage pocket is disposed within and affixed to the rear side of the leg enclosure portion. The interior pocket is of slightly less width than the rear side and is upwardly opening and adapted to hold therein personal items or medical paraphernalia, such as a catheter assembly.

The upper portion is integrally formed from the lower tubular portion at the front side and extends upwardly from the front side for resting upon the seated individual's waist. The upper portion is characterized by a pair of oppositely-disposed, laterally-extending, flaps that are adapted for draping over and covering the individual's thighs, thus covering the waist and the upper thigh area when the individual is seated in a wheelchair.

In order to provide easy and quick access to the contents stored within the interior storage pocket, a centrally located, elongated, vertical zipper extends to the upper edge of the rear side. Unzipping the zipper divides the rear side into two side panels that can be folded away from each other for easy access to the contents of the interior storage pocket.

It is an object of the present invention to provide a lap hugger which fits comfortably on an individual, such as a patient seated in a wheelchair, and which is constructed from material which provides warmth and cushioning for the seated individual.

It is another object of the invention to provide a lap hugger which provides privacy and dignity by giving more coverage for an individual, especially when seated in a wheelchair, than is provided by an ordinary lap robe.

Still another objective of the present invention is to provide a lap hugger which can be instantly removed in an emergency.

Yet another objective of the present invention is to provide an interior storage pocket for containing therein various items ranging from personal accessories to medical paraphernalia.

A further objective of the present invention is to provide a comfort garment which the nursing staff can easily place on the patient and quickly remove therefrom, but which cannot be easily removed by the patient.

Other objects and advantages will become apparent from the following detailed description, forming the specification, taken in conjunction with the accompanying drawings.

BRIEF DESCRIPTION OF THE DRAWINGS

FIG. 1 is a front elevational view of the lap hugger showing the extension of a pair of opposed flaps;

FIG. 2 is a front elevational view of the lap hugger first shown in FIG. 1 with the flaps folded in behind the lap hugger;

FIG. 3 is a rear elevational view of the lap hugger first shown in FIG. 1 showing the extension of the flaps;

FIG. 4 is a rear elevational view of the lap hugger first shown in FIG. 3 with the flaps folded in behind the lap hugger;

FIG. 5 is a rear elevational view of the lap hugger first shown in FIG. 3 illustrating the foldable disposition of a pair of side panels;

FIG. 6 is a side elevational view of the lap hugger first shown in FIG. 1 with a portion of the lap hugger broken out to show an interior storage pocket;

FIG. 7 is a perspective view of the lap hugger taken from the rear side of the lap hugger; and FIG. 8 is a perspective view of the lap hugger placed on a patient seated in a wheelchair.

DETAILED DESCRIPTION OF THE PREFERRED EMBODIMENT

FIGS. 1–8 illustrate a comfort garment for use by an individual. More specifically, the comfort garment of the present invention is a lap hugger 10 which can be used by an individual when seated or reclining on a rocking chair, chaise lounge, bed, sofa, or wheelchair. When used by a patient 12 seated in a wheel-chair 14, as shown in FIG. 8, the lap hugger 10 takes the place of and is an improvement over a lap robe. The lap hugger 10 provides warmth and comfort for the patient 12 and is made from a soft, pliable fabric which is easily washable. When not in use, the lap hugger 10 can be folded up or hung on a hanger. The main purpose of the lap hugger 10 is for use with geriatric, recliner or wheelchair-bound patients, and it includes a number of advantageous features when applied to confused, incontinent and/or catheterized patients.

Referring to FIGS. 1–4, the lap hugger 10 is a one-piece article of a unitary construction having a lower tubular leg enclosure portion 16 and an upper portion 18 integrally formed from and extending upwardly from the lower portion 16. The lower portion 16 defines an inner cavity 17 and has a front side 20 and a rear side 22 which are joined at a closed bottom end 24, and the cavity 17 is adapted to receive and contain therein the legs of the seated patient 12. The end 24 is a square-shaped piece of material sewn to the front 20 and the rear 22 by a continuous peripheral seam of double width quilt binding. FIG. 6 shows the jointure of the end 24 to the rear 22. In FIG. 6 a portion of the seam is shown and the lower portion 16 is shown as an almost bucket-shaped structure. FIG. 6 illustrates the generally cylindrical shape the lower portion 16 would take if it were placed with the end 24 contiguous to a level surface. The lower portion 16 includes an open upper end 26 through which the individual's legs can be placed for enclosure within the cavity 17. If the individual is seated upright in a chair, the front 20 will extend upward from the end 24, completely covering his legs, and will generally extend up to his waist. The rear 22 will extend upward from the end 24 and will cover the back of the legs and extend up to the rear thigh area of the individual. Thus, as shown in FIG. 8, the legs of the patient 12 will be covered on all sides to ensure privacy, and because the lower portion 16 fits closely to the legs, it will not get caught in wheelchair wheels. When the legs of the patient 12 are placed through the end 26 and into the cavity 17, the soft, warm, insulative fabric encompasses and enwraps the legs providing warmth and cushioning from any hard, sharp edges of the wheelchair 14 in which the patient 12 is seated.

Referring to FIGS. 1, 3, 5, 7, and 8, the upper portion 18 is integrally attached to the lower portion 16 at the front 20 and extends upwardly therefrom for resting upon and covering the waist of the patient 12 as shown in FIG. 8. FIGS. 1 and 3 illustrate, respectively, a front view and a rear view of the upper portion 18. The upper portion 18 is integrally formed from the lower portion 16 and, because of this, there is no need for any seam or jointure attaching the upper portion 18 to the front 20. The upper portion 18 includes a pair of oppositely-disposed, laterally-projecting flaps 28 which project outwardly and away from the upper portion 18 when the lap hugger 10 is laid out on a flat surface. The flaps 28 are integrally formed from the upper portion 18 and are flexible, foldable, and terminate at a generally vertical, long edge 30.

When the patient 12 is seated in the wheelchair 14, as shown in FIG. 8, the flaps 28 are draped over the upper thighs, from the front of the patient 12 for covering any exposed areas of the waist or upper thighs. The flaps 28 can also be tucked underneath the patient 12 if desired. Thus, the upper portion 18 securely and comfortably enwraps or encloses the patient 12 in the area from the upper thighs to the waist.

As illustrated in FIGS. 1–5, 7, and 8, a small exterior pocket 32 is affixed on the outer surface of the upper portion 18. The pocket 32 is externally located on the upper portion 18 for easy access by the patient 12 and may hold therein small personal items and effects. For ease of access by geriatric patients, the pocket 32 is preferably of a muff-type design or shape with spaced-apart lateral openings through which the hands of the patient 12 can be inserted, as shown in FIG. 8.

Referring to FIGS. 5 and 6, in addition to the pocket 32 on the upper portion 18 there is an interior storage pocket 34 located within the cavity 17. More specifically, the pocket 34 is disposed within the cavity 17 and is affixed at its inner, continuous peripheral edge to the rear 22. As shown in FIGS. 3, 4, 5, and 7, the pocket 34 is upwardly opening and has a width slightly less than the width of the rear 22. The pocket 34 is preferably stitched or sewn to the inner surface of the rear 22 along the continuous, U-shaped, peripheral seam 36, illustrated in FIGS. 3, 4, 5, and 7. The pocket 34 has a substantial depth which allows it to contain a number of items which can include personal accessories and effects or medical equipment, such as a catheter assembly which may include a Foley catheter drainage bag 37. Because the pocket 34 is located on the rear 22, any medical paraphernalia disposed within the pocket 34 are hidden from view and yet are in close proximity to the individual's lower body, thus avoiding the dangling, binding, and twisting of hoses and tubing that otherwise might occur if a catheter assembly, for example, were suspended from an arm of the wheelchair 14. In addition, the position of the pocket 34 is in compliance with Federal regulations directing that urine bags, like the Foley bag 37, are below the level of the bladder and that the tubing does not touch the floor.

In order to provide easy access to the pocket 34 when medical paraphernalia is disposed therein, the lap hugger 10 includes an elongated, generally vertical closure means. As illustrated in FIGS. 3–5 and 7, the closure means is centrally located on the rear 22 and extends from an upper rear seam or edge 38 of the rear 22, about halfway down, terminating before the horizontal portion of the seam 36 which attaches the pocket 34 to the rear 22. With the employment of the vertical closure means, the rear 22 can be divided into a pair of side panels 40 which are adapted to be fastened together and unfastened for spatial separation in a foldable disposition as shown in FIG. 5. The closure means includes a zipper 42 centrally positioned on the rear 22 which fastens the side panels 40 together and which, when unzipped, unfastens the side panels 40 to permit easy access to any articles or items contained within the pocket 34. Furthermore, if the patient 12 has trouble guiding and directing his or her feet into the cavity 17, the zipper 42 can be undone to allow easier insertion of the feet of the patient 12 into the lower portion 16. When the patient 12 has his or her feet completely disposed within the lower portion 16 and the catheter assembly, for example, is disposed within the pocket 34, the side panels 40 can be fastened together by the zipper 42 so that the catheter assembly can be fully and completely contained within the pocket 34 hidden from view, below the bladder, and above the floor.

In order to properly situate and to provide more comfort for the patient 12 seated on the wheelchair 14, and to reduce soiling of the lap hugger 10 by incontinent patients, a wheel-chair/recliner seat pad is used. The seat pad is of two standard types: an egg crate (foam rubber) or a cloth (incontinent) pad. FIG. 8 shows a seat pad 44 jutting several inches out from the forward edge 46 of the wheelchair 14. When the patient 12 is seated on the wheelchair 14, the edge 38 of the lap hugger 10 should extend several inches under the pad 44 (if the pad 44 is used). The weight of the upper thighs of the patient 12 pressing the edge 38 against the forward edge 46 would keep the lower portion 16 in place and provide the necessary support for articles or medical paraphernalia that might be placed in the pocket 34. In addition, placement of the edge 38 underneath the pad 44 helps to prevent the lap hugger 10 from being soiled.

While there is shown and described a preferred embodiment of the invention, it is to be understood that the structure is susceptible to change and modification within the practicability of the invention and, therefore, should be limited only by the scope of the claims appended thereto.

I claim:

1. A garment for receiving and containing the legs and resting upon the waist of an individual seated in a chair, comprising:

a lower tubular leg enclosure portion defining an inner cavity for receiving the individual's legs, the leg enclosure portion having a closed bottom end and an open upper end through which the individual's legs are placed;

the lower tubular leg enclosure portion further characterized by a front side for covering the individual's legs and a rear side for extending up to and covering the thighs of the individual's legs;

the rear side terminating at an upper rear edge which lays upon a forward edge of the chair for keeping the lower portion in place by the weight of the individual's thighs pressing the upper rear edge against the forward edge of the chair;

an upper portion integrally attached to the leg enclosure portion at the front side and generally extending to the waist of the seated individual;

the upper portion further characterized by a pair of opposed flaps integrally formed from and extending transverse to the upper portion for draping over and covering the thighs of the individual seated in the chair;

an interior storage pocket affixed to the rear side of the leg enclosure portion for disposition within the inner cavity for holding medical equipment and concealing the medical equipment from view; and a closure means located on the rear side of the leg enclosure portion for permitting selective access to the interior storage pocket in order to place medical equipment within the storage pocket or remove medical equipment therefrom.

2. The garment of claim 1 wherein the rear side includes a pair of side panels adapted to be fastened together and unfastened by the closure means.

* * * * *